US010434481B2

(12) United States Patent
Boettcher et al.

(10) Patent No.: US 10,434,481 B2
(45) Date of Patent: Oct. 8, 2019

(54) MIXING VESSEL WITH LOCKING ASSEMBLY FOR LOCKING A MIXING ASSEMBLY IN STORAGE POSITION AND MIXING IMPELLER WITH CENTRAL DISC-LIKE MEMBER

(71) Applicants: Sartorius Stedim Biotech GmbH, Goettingen (DE); Jonathan E. Cutting, East Setauket, NY (US); Mike Bates, Stonehouse, Gloucestershire (GB)

(72) Inventors: Lars Boettcher, Melsungen (DE); Jonathan E. Cutting, East Setauket, NY (US); Sharon D. West, Sunnyside, NY (US); Martin Oschwald, Tagelswangen (CH); Mike Bates, Stonehouse (GB)

(73) Assignee: Sartorius Stedim Biotech GmbH (DE)

( * ) Notice: Subject to any disclaimer, the term of this patent is extended or adjusted under 35 U.S.C. 154(b) by 652 days.

(21) Appl. No.: 15/010,260

(22) Filed: Jan. 29, 2016

(65) Prior Publication Data

US 2017/0216788 A1 Aug. 3, 2017

(51) Int. Cl.

| | |
|---|---|
| ***B01F 7/00*** | (2006.01) |
| ***B01F 7/22*** | (2006.01) |
| ***B01F 15/00*** | (2006.01) |
| ***B01F 13/08*** | (2006.01) |

(52) U.S. Cl.

CPC ..... *B01F 7/00208* (2013.01); *B01F 7/00341* (2013.01); *B01F 7/22* (2013.01); *B01F 13/0827* (2013.01); *B01F 15/0085* (2013.01); *B01F 15/00662* (2013.01); *B01F 15/00876* (2013.01)

(58) Field of Classification Search

CPC ..... B01F 7/00208; B01F 7/00341; B01F 13/0818; B01F 13/0827; B01F 15/00662; B01F 15/0085; B01F 15/00876

See application file for complete search history.

(56) References Cited

U.S. PATENT DOCUMENTS

2006/0092761 A1* 5/2006 Terentiev ..... B01F 7/162 366/274

* cited by examiner

*Primary Examiner* — Anshu Bhatia

(74) *Attorney, Agent, or Firm* — Gerald E. Hespos; Michael J. Porco; Matthew T. Hespos

(57) ABSTRACT

A mixing vessel for accommodating components to be mixed has a container with at least one mounting depression in a side wall of the container. The mounting depression is adapted so that a mixing impeller housing of a mixing impeller is at least partly insertable, in which at least one magnet is housed for being magnetically connectable to a drive device to be driven. A locking assembly is attachable to the mounting depression from outside for locking the mixing impeller in a storage position, in which the mixing impeller is not rotatable. The locking assembly has a magnetically active element that is adapted to interact with the magnet of the mixing impeller.

7 Claims, 5 Drawing Sheets

Figure 1:
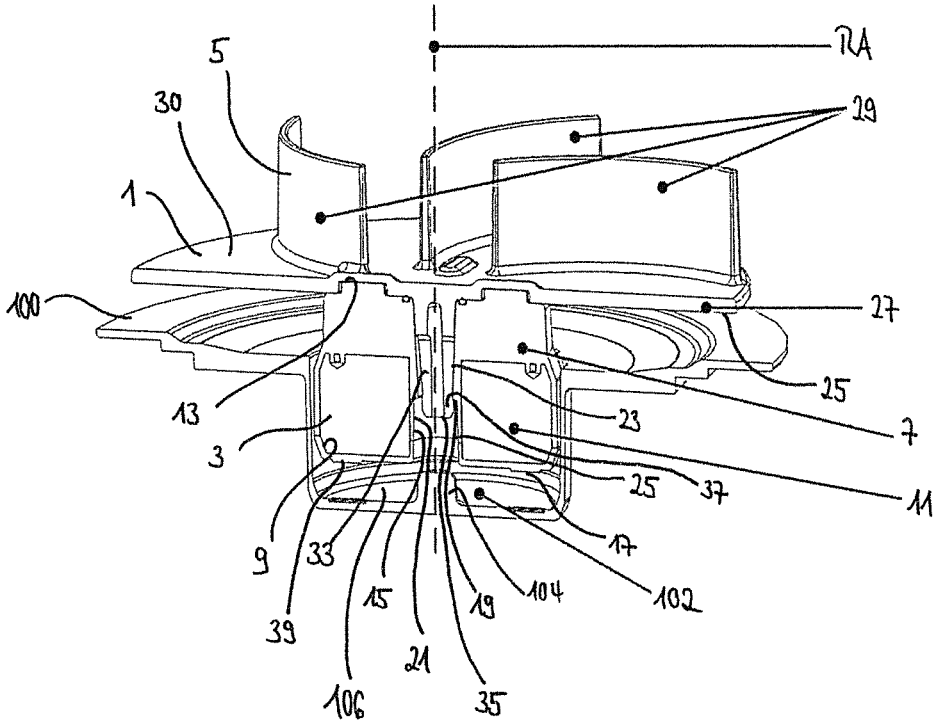

MIXING VESSEL WITH LOCKING ASSEMBLY FOR LOCKING A MIXING ASSEMBLY IN STORAGE POSITION AND MIXING IMPELLER WITH CENTRAL DISC-LIKE MEMBER

BACKGROUND

1. Field of the Invention

The invention relates to a mixing vessel for accommodating components to be mixed. The mixing vessel includes means to lock a mixing impeller in a storage position. The invention also relates to a system comprising the mixing vessel, the mixing impeller and the means to lock the mixing impeller in the storage position, and further to a mixing impeller and a method for assembling.

2. Related Art

In the conventional engineering practice, a mixing device comprises a mixing vessel containing components to be mixed and a motor rotating a mixing impeller such that the components are mixed.

Some applications require that the mixing equipment is fully closed with no possibility of leakage between the mixing vessel and the environment—for example, the fluids to be mixed are either hazardous (e.g. toxic) or if they are sensitive to contamination from the outside environment (e.g. highly purified pharmaceutical material). In such cases a magnet drive system may be employed as a means of transmitting torque between an external motor and a mixing impeller inside of the mixing vessel. A driving magnet at the outside of the mixing vessel is driven by the external motor, and a follower magnet is arranged inside of the mixing impeller in the mixing vessel.

In contrast to the conventional mixing equipment, in which mixing vessels typically are fabricated from stainless steel or other alloys, single-use systems comprise plastic bags as mixing vessels and are used only once. Single-use systems are increasingly used in biopharmaceutical manufacturing operations because of the increased flexibility, lower capital cost, elimination of cleaning steps, reduced risk of cross-contamination, and reduced utility burden.

From the state of the art, single-use mixing impellers are known and comprise a plastic mixing impeller housing having a plurality of mixing blades extending from the mixing impeller housing. One or more magnet(s) are arranged in cavities in the mixing impeller housing. The mixing blades are designed to impart a driving force to the fluid when the mixing impeller is rotated about its rotation axis.

In some cases the mixing impeller housing of the mixing impeller is arranged at least partly in a mounting depression of the mixing vessel. The mounting depression usually is arranged at a bottom side of the mixing vessel. Thus, the magnet is circumferentially accessible by a motor to drive the mixing impeller.

The mixing impeller has a storage position and a mixing position. In the storage position, a bottom surface of the mixing impeller rests on a bottom surface of the mounting depression. In the mixing position, the mixing impeller is levitated along its rotation axis such that there is a clearance underneath the bottom surface of the mixing impeller and the bottom surface of the mounting depression.

The motor must be in a proper position under the mounting depression of the mixing vessel to bring the mixing impeller in the mixing position. At a command from a control device, the motor may rotate the mixing impeller with no contact between the mixing impeller and the mounting depression of the mixing vessel or any other part of the mixing vessel. The contact between moving parts is to be avoided since it can damage sensitive proteins or other biomolecules by grinding and the generation of particulates.

When the mixing impeller is in the storage position, it is desirable to prevent it from rotating relative to the mounting depression. Therefore, it is the underlying technical problem of the present invention to provide a mixing impeller and mixing vessel that reliably secures the mixing impeller in the storage position.

SUMMARY

According to a first aspect of the invention, this problem has been solved by a mixing vessel for accommodating components to be mixed, comprising:

- a container, which has at least one mounting depression in a side wall of the container, wherein the mounting depression is adapted such that a mixing impeller housing of a mixing impeller is at least partly insertable, in which at least one magnet is housed for being magnetically connectable to a drive device to be driven; and
- a locking assembly being attachable to the mounting depression from outside for locking the mixing impeller in a storage position, in which the mixing impeller is not rotatable, wherein the locking assembly comprises a magnetically active element, which is adapted to interact with the at least one magnet of the mixing impeller.

The container may be rigid and made from stainless steel, or may be flexible and made from plastic. A container that is flexible may be formed as a bag. A particular configuration of such a container may be a single-use bioreactor. At a portion of the container where the mounting depression is arranged, a rigid mounting depression may be attached to the flexible material by means of a rigid flange portion. The flange portion may be attached to the flexible material so that the container is safely closed. This could be done by e.g. gluing or ultrasonically welding.

The mounting depression may have a circular shape. The mixing impeller housing that is at least partly insertable into the mounting depression may have a corresponding shape. However, the diameter of the mixing impeller housing is smaller than the diameter of the mounting depression so that the mixing impeller is freely rotatable in the mounting depression.

The mixing blade may extend either radially or axially with respect to a rotation axis of the mixing impeller from the mixing impeller housing. Further, the mixing blade may be vertical or diagonal with respect to the rotation axis of the mixing impeller. Furthermore, the mixing blade may be back-swept (backward leaning with respect to a rotation direction) and/or curved. The shape and size may be chosen according to the components to be mixed (whether the components are solid, gaseous and/or liquid). Further, the shape and size may be chosen according to the size and shape of the mixing vessel in which the mixing impeller is arranged.

The mixing impeller according to the invention may carry out mixing applications like e.g. homogenizing (compensation of concentration differences of different miscible components), liquid/liquid dispersing (stirring in of an insoluble medium into another fluid), liquid/gaseous dispersing (stirring in of gaseous phase into a liquid phase), suspending (swirling up and mixing of solids in a liquid phase), and/or emulsifying (stirring in of a liquid phase into a second liquid).

The magnetically active element is arranged at an outer side of the mounting depression, which means outside of the mixing vessel. By arranging the magnetically active element outside of the mounting depression the at least one magnet is attracted by the magnetically active element that applies a holding force to the mixing impeller in the storage position. In other words, the mixing impeller is not able to rotate. The term "magnetically active" in this respect means that the element is able to attract the at least one magnet of the mixing impeller.

The mixing impeller is intended to be held in the storage position when delivering a single-use mixing vessel together with the already inserted mixing impeller to the user. During the delivery the mixing impeller should be arranged safely without rotating in the mixing vessel. Thus, any defects of the mixing impeller can prevented. Additionally, a locking assembly that comprises the magnetically active element may be attachable to the mounting depression in a releasable manner.

If the mixing vessel is re-usable, the mixing impeller may be in its storage position between its mixing activities.

The magnetically active element may comprise a magnet or may be formed of steel.

The magnet may be a permanent magnet. The magnet and/or the steel may provide a sufficient holding force for holding the mixing impeller in the storage position.

If the locking assembly is larger than the magnetically active element itself, the remaining portion of the locking assembly may be made from plastic.

The magnetically active element may cover at least part of a bottom surface of the mounting depression of the container.

The "bottom surface" of the mounting depression refers to the surface of the mounting depression that is opposite to the side where the opening is provided for inserting the mixing impeller into the mounting depression.

The magnetically active element attracts the mixing impeller towards the bottom surface of the mounting depression. This means that a force is applied to the mixing impeller by the magnetically active element such that the mixing impeller is pulled from the mixing position towards the storage position. Levitating movements of the mixing impeller are then no longer possible. Provided that the magnetically active element is arranged below the bottom surface of the mounting depression, the attraction direction extends along the rotation direction of the mixing impeller and/or the extension direction of the mounting depression.

Alternatively, the magnetically active element may be arranged at a circumferential surface of the mounting depression. In this case the mixing impeller would have been attracted towards the respective position at the circumferential surface of the mounting depression behind which the magnetically active element is arranged. The attraction direction would then be perpendicular to the rotation direction of the mixing impeller and/or the extension direction of the mounting depression.

The locking assembly may be formed as a cap, in which the magnetically active element is included. The cap can be put over the mounting depression, such that the magnetically active element is arranged only in a portion of the cap that covers the bottom side of the mounting depression. It is, however, also possible that the magnetically active element also extends toward a circumferential surface of the cap.

The mounting depression may comprise at least one recess in which a mounting protrusion of the mixing impeller is insertable in the storage position.

As soon as the magnetically active element is attached to the mounting depression, the mixing impeller is attracted towards the magnetically active element. However, the recess of the mounting depression and the mounting protrusion of the mixing impeller are engageable to further prevent any rotational movement of the mixing impeller. At first the mixing impeller may be able to carry out a further small rotational movement. However, after a while the mounting protrusion of the mixing impeller will reach the recess of the mounting depression so that they engage.

The shape and/or size of the recess of the mounting depression shall correspond to the shape and/or size of the protrusion of the mixing impeller such that the protrusion may perfectly fit into the recess. Thus, any rotational movement of the mixing impeller is prevented.

If more than one recess and/or mounting protrusion is provided, they may be arranged so that an engagement is achieved as fast as possible even if the mixing impeller rotates for a small distance.

Although it is described above that the at least one recess is formed in the mounting depression and the mounting protrusion is formed in the mixing impeller, it is also possible to interchange them.

The recess may be formed in a bottom surface of the mounting depression and the mounting protrusion may be formed in a bottom surface of the mixing impeller that faces the bottom surface of the mounting depression in the storage position.

At least a portion of a bottom surface of the mounting depression may be patterned. As a "patterned" surface, one understands a surface which is not flat or is uneven.

A bottom surface of the mixing impeller may be shaped so that an engagement configuration between the mixing impeller and the mounting depression may be achieved in the storage position of the mixing impeller. Again, the mixing impeller may be still rotatable for a while in the storage position. However, this rotational movement is stopped as soon as the mixing impeller reaches a position where the patterned surfaces of the mixing impeller and the mounting depression engage.

The patterned surface may comprise inclined surfaces intersecting in a center of the mounting depression.

In other words, the bottom surface of the mounting depression may have a folded structure, while each fold extends from a center of the mounting depression radially outward with respect to the rotation axis of the mixing impeller. The height and/or the width of each fold is preferably identical.

A central protrusion may project from a center of a bottom surface of the mounting depression for being engageable with a corresponding central mixing impeller recess in a center of the mixing impeller. The central protrusion may have at least partly a polygonal circumferential surface.

The central protrusion may be provided in the center of the mounting depression and may at least partly project into a central mixing impeller recess in a center of the bottom surface of the mixing impeller in the storage position. The length of the central protrusion, however, may be constructed such that the central protrusion only engages with the central mixing impeller recess in the storage position. Thus, a free rotational movement of the mixing impeller in the mixing position is enabled, in which the mixing impeller freely rotates when levitating in the mounting depression.

The circumferential surface of the central protrusion may be polygonal to block a rotational movement of the mixing impeller in the storage position. In particular, the central protrusion may have a quadrangular, pentagonal, hexagonal, heptagonal or octagonal shape in cross-section.

A circumferential surface of the central mixing impeller recess may have a corresponding shape, so that a rotational movement of the mixing impeller is blocked in the storage position, where the central mixing impeller recess and the central protrusion engage.

It is pointed out that the above mentioned options of blocking a rotational movement of the mixing impeller in the storage position may be used alternatively or in combination.

According to another aspect of this disclosure, the underlying technical problem has been solved by a system comprising:

a mixing vessel comprising a container, which has at least one mounting depression in a side wall of the container;

at least one mixing impeller comprising a mixing impeller housing, in which at least one magnet is housed and which is magnetically connectable to a drive device to be driven, and at least one mixing blade attached to the mixing impeller housing so that components are mixed when rotating the mixing impeller;

a locking assembly being attachable to the mounting depression from outside for locking the mixing impeller in a storage position, in which the mixing impeller is not rotatable, wherein the mixing impeller housing is at least partly inserted in the mounting depression, and wherein the locking assembly comprises a magnetically active element, which is adapted to interact with the at least one magnet of the mixing impeller.

The magnetically active element may comprise a magnet or may be formed of steel.

The magnetically active element may at least partly cover a bottom surface of the mounting depression of the container.

The mounting depression may comprise at least one recess and the mixing impeller may comprise a mounting protrusion engageable with the recess in the storage position.

A bottom surface of the mounting depression may have inclined surfaces that intersect in a center of the mounting depression and that can engage corresponding surfaces of a bottom surface of the mixing impeller in the storage position of the mixing impeller, thereby preventing a rotational movement of the mixing impeller.

A central protrusion may project from a center of a bottom surface of the mounting depression for engaging a corresponding central mixing impeller recess in a center of the mixing impeller in the storage position of the mixing impeller such that a rotational movement of the mixing impeller is prevented. The central protrusion may have at least partly a polygonal circumferential surface.

According to a further aspect of this disclosure, the underlying technical problem has been solved by a method of assembling, comprising:

providing a mixing vessel comprising a container, which has at least one mounting depression in a side wall of the container;

providing at least one mixing impeller comprising a mixing impeller housing, in which at least one magnet is housed and which is magnetically connectable to a drive device to be driven, and at least one mixing blade attached to the mixing impeller housing so that components are mixed when rotating the mixing impeller;

inserting the mixing impeller housing at least partly into the mounting depression of the mixing vessel; and attaching a locking assembly, to the mounting depression from outside for locking the mixing impeller in a storage position, in which the mixing impeller is not rotatable, wherein the locking assembly comprises a magnetically active element, which is adapted to interact with the at least one magnet of the mixing impeller.

According to another aspect of the disclosure, it is known that single-use mixing vessels commonly are used to blend two mixable liquids or to dissolve powder in a liquid solution. Mixing two or more liquids is usually the easier case. For powder dissolution, however, a large quantity of powder is added through a port at the top of the single-use mixing vessel. The powder may sink down and fall on the mixing impeller immediately after addition, or it may settle out of a suspension after mixing is stopped. Powder that becomes trapped in a gap between the mixing impeller and a side wall of the mounting depression of the mixing vessel might render the mixing impeller unable to start.

Accordingly, a further technical problem is to provide a mixing impeller for mixing components, which enables a reliable powder dissolution.

According to a further aspect of this disclosure, this technical problem has been solved by a mixing impeller for mixing components in a single-use mixing vessel, comprising:

a disc-like member having a center through which a rotation axis of the mixing impeller extends;

a mixing impeller housing attached to a first side of the disc-like member, wherein the mixing impeller housing houses at least one magnet and is adapted to be insertable in a mounting depression of the single-use mixing vessel, wherein the at least one magnet is magnetically connectable to a drive device to be driven; and at least one mixing blade attached to the disc-like member, such that the at least one mixing blade extends from the disc-like member and mixes the components to be mixed when rotating the mixing impeller.

Any information already given with respect to the mixing impeller housing of a mixing impeller and single-use mixing vessels above already applies for the present mixing impeller. Furthermore, any information given with respect to a mounting depression in a side wall of the mixing vessel given above also applies for the present mixing impeller.

The disc-like member may be rotationally symmetric and hence may have e.g. a circular or hexagonal shape. The disc-like member may be formed as a plate. The first side of the disc-like member corresponds to the bottom side of the disc-like member with respect to the rotation axis of the mixing impeller. The second side of the disc-like member accordingly corresponds to a top side of the disc-like member.

The at least one mixing blade is attached to the disc-like member and extends from the disc-like member. The mixing blade may be flat or curved. Further, the mixing blade may be back-swept with respect to a rotation direction of the mixing impeller. If more than one mixing blade is attached to the disc-like member, the mixing blades may differ in their size and shape.

The disc-like member may have a larger diameter than the diameter of the mounting depression so that the mounting depression is covered fully and no powder is able to fall into the mounting depression. Thus, the motor can provide enough torque to rotate the mixing impeller, especially when starting the mixing impeller The at least one mixing blade may be arranged on the disc-like member and may extend axially with respect to the rotation axis from the disc-like member.

This means that the at least one mixing blade is arranged on the second side of the disc-like member and extends from the disc-like member in an axial direction with respect to the rotation axis of the mixing impeller.

Alternatively, the at least one mixing blade is attached to circumferential surface of the disc-like member and extends radially from the disc-like member with respect to the rotation axis of the mixing impeller. Such an arrangement of mixing blades is known e.g. from a Rushton impeller.

The mixing blade may be arranged fully on the top side of the disc-like member without extending beyond the disc-like member in a radial direction.

This prevents a potentially hazardous contact between the flexible side wall material of the mixing vessel and the mixing blades when the flexible mixing vessel is folded underneath the mixing blades.

Moreover, the disc-like member stiffens the mixing blades that would otherwise be unsupported, thereby reducing deflection and possible breakage.

The disc-like member may be flat or conical to the top of the disc-like member or may be dome-shaped.

If the disc-like member is conical to the top of the disc-like member or dome-shaped, liquid is further prevented from resting on the top of the disc-like member when draining the singe-use mixing vessel. The high value of biological material means that holdup (i.e. leftover material which cannot be removed from the single-use mixing vessel) is to be avoided at all costs.

These and other objects, features and advantages of the invention will become more evident by studying the following detailed description of preferred embodiments and the accompanying drawings. Further, although embodiments are described separately, single features can be combined for additional embodiments.

DETAILED DESCRIPTION

FIG. 1 Is a cross-sectional perspective view of a mixing impeller being inserted in a mounting depression of a mixing vessel.

Figure 2A:
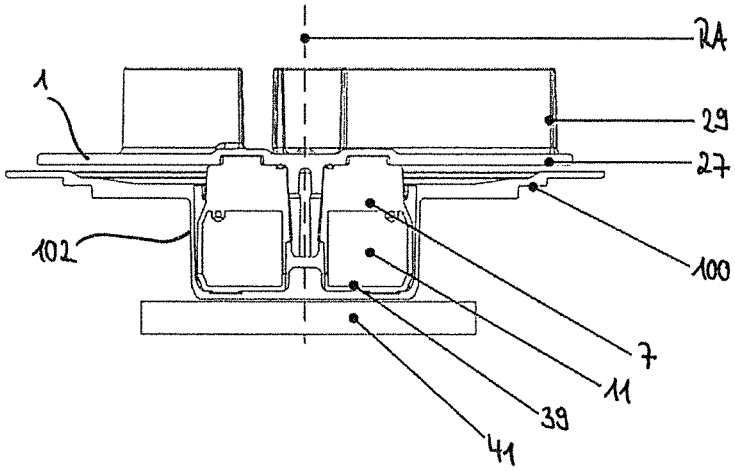

FIG. 2*a* is a cross-sectional view of the mixing impeller of FIG. 1 with the mixing impeller in the storage position.

Figure 2B:
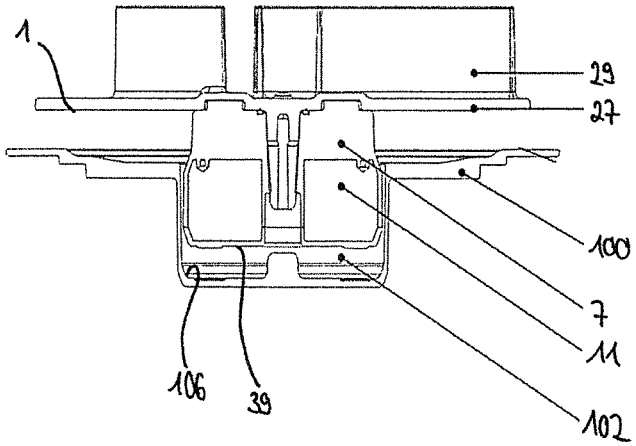

FIG. 2*b* is a cross-sectional view of the mixing impeller of FIG. 1 with the mixing impeller in the mixing position.

Figure 3A:
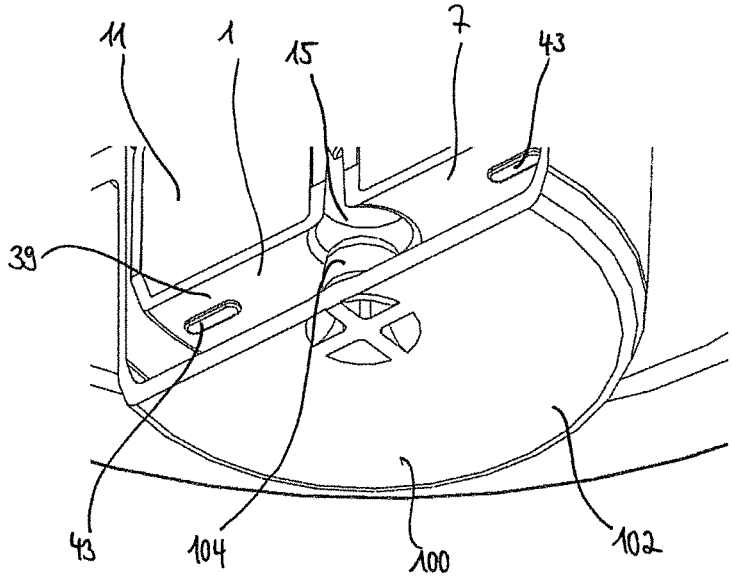

FIG. 3*a* is a cross-sectional perspective view showing the mixing impeller inserted in the mounting depression and oriented to show the bottom of the mixing impeller and showing a first option for additionally blocking rotational movement of the mixing impeller in the storage position.

Figure 3B:
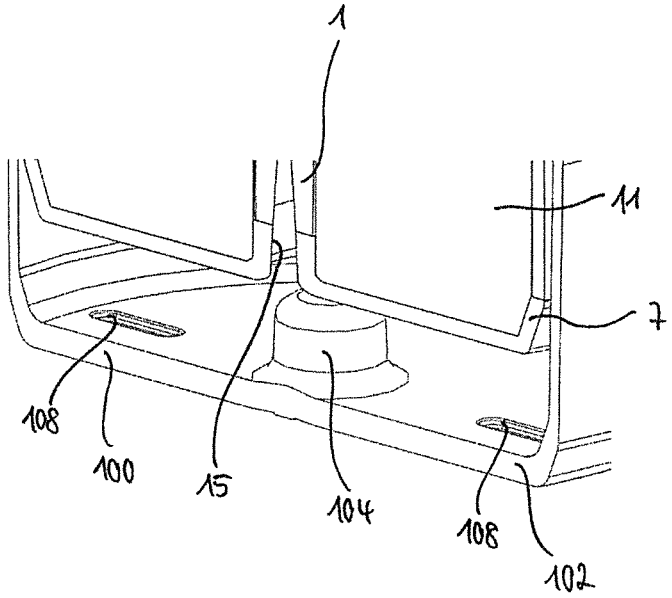

FIG. 3*b* is a cross-sectional perspective view showing the mixing impeller inserted in the mounting depression and oriented to show the bottom of the mounting depression of FIG. 3*a*.

Figure 4A:
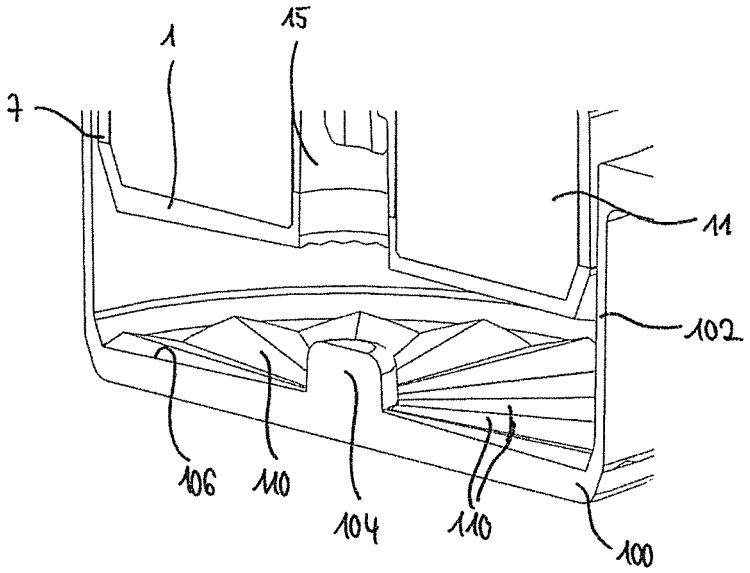

FIG. 4*a* is a cross-sectional perspective view similar to FIG. 3*b*, but showing a second option for additionally blocking a rotational movement of the mixing impeller in the storage position.

Figure 4B:
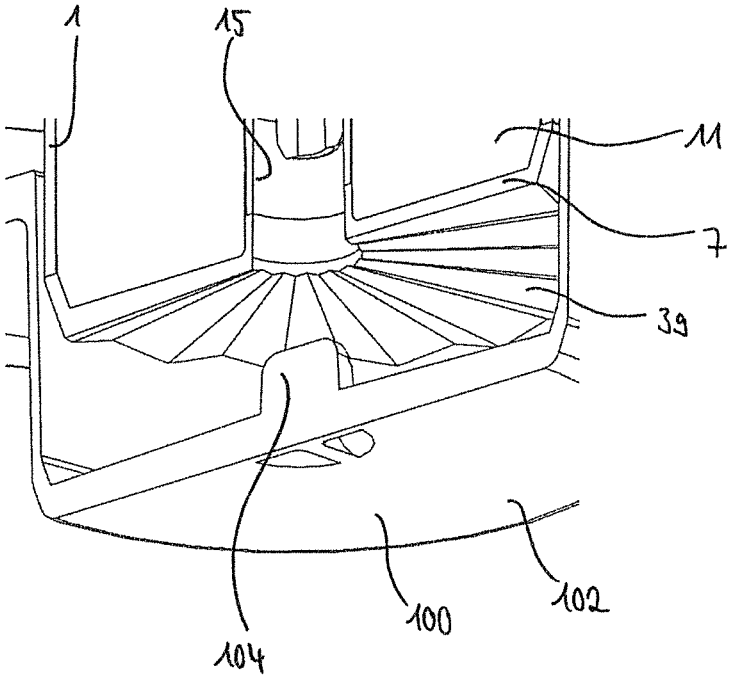

FIG. 4*b* is a cross-sectional perspective view similar to FIG. 3*a*, but showing the second option for additionally blocking a rotational movement of the mixing impeller in the storage position.

Figure 5A:
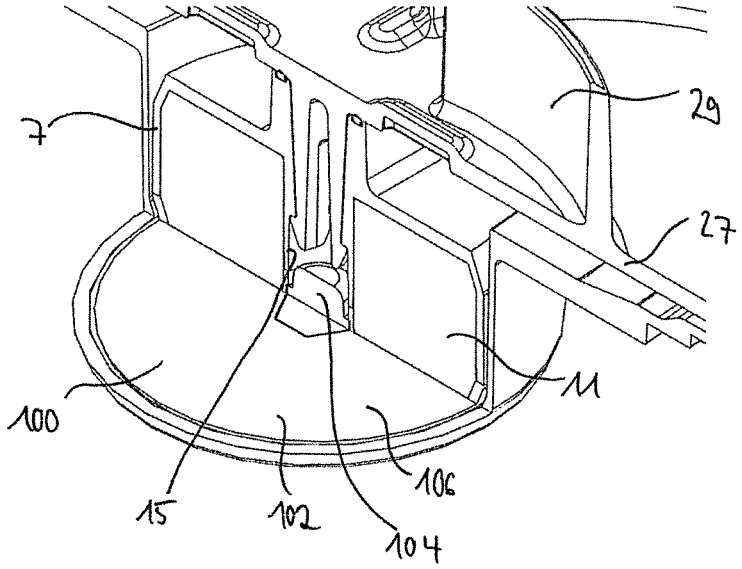

FIG. 5*a* is a cross-sectional perspective view similar to FIG. 4*a*, but showing a third option for additionally blocking a rotational movement of the mixing impeller in the storage position.

Figure 5B:
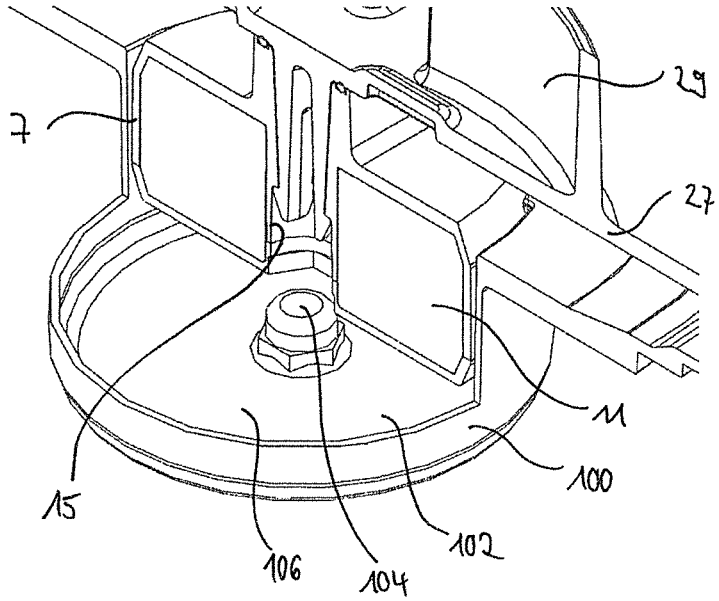

FIG. 5*b* is a cross-sectional perspective view similar to FIG. 4*a*, but showing a third option for additionally blocking a rotational movement of the mixing impeller in the storage position.

DETAILED DESCRIPTION

FIG. 1 shows a cross-sectional view of a mixing impeller 1 for mixing components in a mixing vessel 100 that is partly shown.

The mixing impeller 1 comprises a first subassembly 3 and a second subassembly 5 that are formed separately, but that are connectable by means of an engagement mechanism.

The first subassembly 3 comprises a mixing impeller housing 7, which preferably has a circular shape and/or is made of plastic. Inside of said mixing impeller housing 7, at least one accommodation space 9 is provided for accommodating a magnet 11. If more than one accommodation space 9 is formed in the first subassembly 3, preferably each of said accommodation spaces 9 is filled with a magnet 11. In the case of FIG. 1, one accommodation space 9 is formed in the mixing impeller housing 7 having a ring-shape. A ring-shaped magnet 11 is inserted into said accommodation space 9. The size of the accommodation space 9 preferably corresponds to the size of the magnet 11 so that the magnet 11 is not able to shift inside of the accommodation space 9 when rotating the mixing impeller 1. The number, size, shape and arrangement of the at least one magnet depends of the drive device with which the magnet 11 is to be coupled magnetically to be driven. For example, the magnet 11 of FIG. 1 could work as a follower magnet. A motor outside of the mixing vessel 100 could comprise a drive magnet. If the drive magnet driven by the motor rotates, the follower magnet 11 being magnetically coupled with the drive magnet also rotates. The drive magnet, however, might also consist of a plurality of drive magnets which are arranged in a circle. In this case, the follower magnet 11 in the first subassembly 3 would have to comprise the same number of magnets, which are arranged similarly. Preferably, the at least one magnet is fully encapsulated in the mixing impeller housing 7 such that any contact between the components to be mixed and the magnet 11 can be prevented.

Further, at least one upper recess is provided in an upper side 13 of the mixing impeller housing 7, which faces the second subassembly 5 in the mounted state. The at least one recess penetrates the mixing impeller housing 7 substantially along a rotation axis RA of the mixing impeller 1. In the case of FIG. 1, the recess is formed as a through hole 15 that extends from the upper side 13 towards a lower side 17 of the first subassembly 3 along the rotation axis RA. The ring-shaped magnet 11 surrounds the through hole 15.

The through hole 15 is described further herein. However, it is pointed out that the following information also applies for a recess.

At least one protrusion 19 is provided in the through hole 15 and at least partly extends along the circumferential wall 21 of the through hole 15. The protrusion 19 may be formed as a bulge or, as in the case of FIG. 1, as a step. As shown in FIG. 1, the through hole 15 is separated into an upper portion 23 and a lower portion 25 separated by the protrusion 19. The upper portion 23 is closer to the second subassembly 5 in the mounted state and preferably has a smaller cross-section perpendicular to the rotation axis RA, while the lower portion 25 has a wider cross-section.

The second subassembly 5 may comprise of a disc-like member 27, which is rotationally symmetrical and preferably circular. The rotation axis RA extends through a center of the disc-like member. At least one mixing blade 29 is attached to the disc-like member 27. Preferably, the second subassembly 5 is formed of plastic and/or all elements of the second subassembly 5 are formed unitarily. The at least one mixing blade 29 is arranged on a top side 30 of the disc-like member 27 and, as shown in FIG. 1, extend axially from the disc-like member 27 with respect to the rotation axis RA. The mixing blade 29 may have a variety of shapes, sizes and/or arrangement. For example, the mixing blade 29 may be flat or curved. As shown in FIG. 1, the mixing blade 29 is arranged on the disc-like member 27 so that it does not extend beyond the disc-like member 27 in a radial direction. Preferably, mixing blades 29 are arranged on the disc-like member 27 so that they intersect at the rotation axis RA of the mixing impeller 1. If more than one mixing blade 29 is arranged on the disc-like member 27, the mixing blades 29 may differ in their shapes and size. As the second subassembly 5 is connectable to the first subassembly 3, the configuration of the second subassembly 5 is chosen selectively according to the mixing application, i.e. with respect to the components to be mixed. This can be done e.g. by a person who assembles e.g. a single-use mixing vessel or by the user who has extending skills regarding this matter when using a reusable mixing vessel.

Although the disc-like member 27 is shown in a flat configuration in FIG. 1, the disc-like member 27 may be conical or dome-shaped.

At least one engagement member 33 is arranged at a lower side 31 of the disc-like member 27, which faces the first subassembly 3 in the mounted state. In the case of FIG. 1, the engagement member 33 is formed as a rod. A free end 35 of the engagement member 33 defines an enlarged end portion 37 that preferably has the shape of a mushroom head. Furthermore, the engagement member 33 may taper towards the free end 35, as shown in FIG. 1.

In order to connect the first and second subassemblies 3 and 5, the at least one engagement member 33 is insertable into the through hole 15 of the first subassembly 3. Preferably, the through hole 15 has a size and shape such that at least partly a force fit and/or tight fit appears between the first and second subassemblies 3 and 5. Thus, the first and second subassemblies 3 and 5 are connected/engaged so that a reliable connection is provided.

The engagement member 33 is inserted into the through hole 15 such that the enlarged end portion 37 of the engagement member 33 engages the protrusion 19. Preferably, the enlarged end portion 37 tapers toward its free end so that the enlarged end portion 37 is able to easily pass the narrow upper portion 23 of the through hole 15 when being inserted. In particular, the enlarged end portion 37 of the engagement member 33 may be compressible so that the enlarged end portion 37 is able to pass the upper portion 23 of the through hole 15. The enlarged end portion 37 may expand again after passing the upper portion 23.

Thus, a snap-fit mechanism is provided and allows an easy connection between the first and second subassembly 3 and 5 to be done manually by the user or a person when assembling the mixing vessel. Moreover, this connection may be releasable so that the second subassembly 5 can be removed and exchanged by another second subassembly 5. In other words, the user can selectively chose the second subassembly 5 having the perfect geometry (especially with respect to the mixing blades) for the relevant mixing application to be carried out by the mixing impeller 1. The first subassembly 3, which contains the expensive magnet 11, however, remains in the mixing vessel.

Although the first and the second subassembly 3 and 5 are connected via the above described snap-fit mechanism in FIG. 1, it is also possible that the first and second subassembly 3 and 5 are connected by gluing or ultrasonically welding.

FIG. 1 shows a state in which the mixing impeller 1 in its mounted state (the first and second subassembly 3 and 5 are connected) is inserted in a mixing vessel 100, which is partly shown. In particular, the mixing impeller housing 7 may be inserted at least partly into a mounting depression 102 of the mixing vessel 100, which is preferably in a bottom surface of the mixing vessel 100. The portion of the mixing vessel 100 that has the mounting depression 102 may be formed as a rigid portion when the mixing vessel 100 is a single-use mixing vessel 100 formed as a flexible bag. The rigid portion is e.g. ultrasonically welded to the flexible portion of the side of the mixing vessel 100 by means of a flange portion.

A central protrusion 104 may be provided in the mounting recess 102 and may be configured such that it is at least partly insertable into the through hole 15 of the mixing impeller housing 7 in order to hold the mixing impeller 1 reliably in the mixing vessel 100 in a storage position.

As shown in FIG. 1, the disc-like member 27 has a larger diameter than the diameter of the mounting depression 102 of the mixing vessel 100. Accordingly, the disc-like member 27 fully covers the mounting depression 102, so that no powder is able to fall into the mounting depression 102, which may be dispensed into the mixing vessel 100 from above. Thus, the starting torque of the mixing impeller 1 is increased. Further, it prevents a potentially hazardous contact between the flexible side wall material of the mixing vessel 100 and the mixing blades 29 when the flexible mixing vessel 100 is folded underneath the mixing blades 29. Moreover, the disc-like member 27 stiffens the otherwise unsupported mixing blades 29, thereby reducing deflection and possible breakage.

FIGS. 2*a* and 2*b* show a cross-sectional view of the mixing impeller 1 of FIG. 1. In FIG. 2*a*, the mixing impeller 1 is in its storage position, in which the mixing impeller 1 is not rotating (for example when delivering the single-use mixing vessel 100 together with the inserted mixing impeller 1 to the user). In particular, a bottom surface 39 of the mixing impeller 1 rests on a bottom surface 106 of the mounting depression 102. When e.g. delivering the mixing vessel 100 together with the inserted mixing impeller 1 to the user, both elements are moved so that the mixing impeller 1 usually cannot reliably be held in this storage position. Therefore, a locking assembly is attached to an outer side of the mounting depression 102 preferably below the bottom surface 106 of the mounting depression 102. The locking assembly comprises at least one magnetically active element 41 that may comprise a magnet (i.e. a permanent magnet) or is made of steel.

The magnetically active element 41 is adapted to attract the magnet 11 inside of the mixing impeller 1 so that the mixing impeller 1 is held at a fixed position inside of the mounting depression 102.

In FIG. 2*a*, the magnetically active element 41 is formed as a plate, which extends over the whole area of the locking assembly. However, it is also possible to form the locking assembly as a cap that is put over the mounting depression 102 from outside and the magnetically active element 41 covers at least partly the bottom surface 106 of the mounting depression 102. The remaining portion of the locking assembly where no magnetically active element 41 is present may be made from plastic.

FIG. 2*b* shows the same mixing impeller 1, however, in its mixing position. The locking assembly is not present so that the mixing impeller 1 is freely rotatable. The magnet 11 of the mixing impeller 1 is magnetically connected to a drive device (not shown) disposed outside of the mixing vessel 100 and operative to rotate the mixing impeller 1. Thus, the mixing impeller 1 is lifted slightly inside the mounting depression 102 so that the bottom surface of the mixing impeller housing 39 is no longer in contact with the bottom surface 106 of the mounting depression 102. In other words, the mixing impeller 1 is levitating in the mounting depression 102.

Further means may be provided in the mixing impeller 1 and the mounting depression 102 to improve the holding force for holding the mixing impeller 1 in the storage position, especially with respect to the prevention of any rotational movements in the storage position. These means may be used alternatively or in addition to each other.

FIGS. 3*a* and 3*b* show a first option for preventing any rotational movements of the mixing impeller 1 in the storage position.

FIG. 3*a* shows a partial cross-sectional view of the mixing impeller 1 inserted in the mounting depression 102, but turned such that the bottom surface 39 of the mixing impeller housing 7 is visible.

At least one mounting protrusion 43 is at the bottom surface 39 of the mixing impeller housing 7 and projects towards the bottom surface 106 of the mounting depression 102 of the mixing vessel 100. In FIG. 3*a*, two mounting protrusions 43 are shown and both have an elongated rectangular shape. It is, however, also possible that the mounting protrusions 43 have a different shape like e.g. circular, triangular or hexagonal shape. Preferably and as shown in FIG. 3*a*, the mounting protrusions 43 are arranged circularly around the rotation axis RA of the mixing impeller 1.

FIG. 3*b* shows the partial cross-sectional view of the mixing impeller 1 inserted in the mounting depression 102 of FIG. 3*a* but turned such that a bottom surface 106 of the mounting depression 102 is visible.

FIG. 3*b* shows that the bottom surface 106 of the mounting depression 102 provides at least one recess 108 into which the at least one mounting protrusion 43 of the mixing impeller 1 is insertable in the storage position. Preferably, the number, shape and/or size of the recesses 108 and the mounting protrusions 43 correspond to each other so that they can perfectly engage with each other. As soon as the magnetically active element 41 attracts the mixing impeller 1 towards its storage position so that the bottom surface 39 of the mixing impeller housing 7 rests on the bottom surface 106 of the mounting depression 102, the recesses 108 are engageable with the mounting protrusions 43. Even if they are not leveled initially so that they are engageable, at least after a short rotation of the mixing impeller 1, the engagement is achieved. The higher the number of mounting protrusions 43 and recesses 108 is the faster the engagement position is reached.

A further possibility of restricting any rotational movement of the mixing impeller 1 in the storage position is shown in FIGS. 4*a* and 4*b*.

FIG. 4*a* shows a partial cross-sectional view of the mixing impeller 1 inserted in the mounting depression 102 but turned such that a bottom surface 106 of the mounting depression 102 is visible.

As already described above, in the center of the bottom surface 106 of the mounting depression 102 the central protrusion 104 for engaging with the through hole 15 of the mixing impeller 1 in the storage position is provided. Preferably, the remaining portion of the bottom surface 106 of the mounting depression 102 that surrounds the central protrusion 104 includes at least one inclined surface 110. In particular, the inclined surface 110 is arranged diagonally with respect to an extension direction of the central protrusion that corresponds to the rotation axis RA of the mixing impeller 1. As shown in FIG. 4*a*, a plurality of inclined surfaces 110 may be provided at the bottom surface 106 of the mounting depression 102 such that a folded pattern exists. The inclined surfaces 110 intersect at the center of the bottom surface 106 of the mounting depression 102. In particular, plural folds are provided, whose height and/or width are preferably identical. It is, however, also possible that the bottom surface 106 of the mounting depression 102 is patterned differently, e.g. in a waveform.

FIG. 4*b* shows a partial cross-sectional view of the mixing impeller 1 of FIG. 4*a* inserted in the mounting depression 102 but turned such that the bottom surface 39 of the mixing impeller housing 7 is visible.

Based on this view it can be seen that the bottom surface 39 of the mixing impeller housing 7 has a corresponding shape so that the bottom surface 39 of the mixing impeller 7 is engageable with the bottom surface 106 of the mounting depression 102 in the storage position of the mixing impeller 1. Even if they are not leveled initially so that they are engageable, at least after a short rotation of the mixing impeller 1, the engagement is achieved.

A further possibility of restricting any rotational movement of the mixing impeller 1 in the storage position is shown in FIGS. 5*a* and 5*b*.

FIGS. 5*a* and 5*b* show a cross-sectional view of the mixing impeller 1 inserted in the mounting depression 102 but turned and illustrated such that the bottom surface 106 of the mounting depression 102 is visible.

As best shown in FIG. 5*b* where the mixing impeller is in the mixing position, the central protrusion 104 on the bottom surface 106 of the mounting depression 102 has at least partly a polygonal circumferential surface 112. In particular, the central protrusion 104 may have e.g. a quadrangular, pentagonal, hexagonal, heptagonal or octagonal shape in cross-section.

Further, as shown in FIG. 5*b*, a portion of the circumferential wall 21 of the through hole 15 of the mixing impeller housing 7 has a corresponding wall shape, so that the central protrusion 104 can engage with said portion of the through hole 15 in the storage position of the mixing impeller 1. FIG. 5*a*) shows the engaged state.

Although FIGS. 5*a* and 5*b* show the mixing impeller housing 7 with a through hole 15. It is also possible that a recess is formed in the bottom surface 39 of the mixing impeller 1. The recess would be correspondingly formed.

What is claimed is:

1. A mixing vessel for accommodating components to be mixed and for accommodating a mixing impeller for mixing the components in the mixing vessel, at least one magnet being housed in the mixing impeller, the mixing vessel comprising:

a container that has at least one mounting depression in a side wall of the container, the mounting depression being dimensioned and configured to receive at least part of the mixing impeller; and a locking assembly being attachable to the mounting depression from outside the container for locking the mixing impeller in a storage position, in which the mixing impeller is not rotatable, wherein the locking assembly comprises a magnetically active element that is adapted to interact with the at least one magnet of the mixing impeller.

2. The mixing vessel of claim 1, wherein the magnetically active element comprises a magnet or is formed of steel.

3. The mixing vessel of claim 1, wherein the magnetically active element at least partly covers a bottom surface of the mounting depression of the container.

4. The mixing vessel of claim 1, wherein the mounting depression comprises at least one recess, in which a mounting protrusion of the mixing impeller is insertable in the storage position.

5. The mixing vessel of claim 1, at least a portion of a bottom surface of the mounting depression is patterned.

6. The mixing vessel of claim 5, wherein the patterned surface comprises inclined surfaces intersecting in a center of the mounting depression.

7. The mixing vessel of claim 1, wherein the mixing impeller has a recess formed in a center of the mixing impeller, and wherein the mixing vessel has a central protrusion projects from a center of a bottom surface of the mounting depression for being engageable with the recess of the mixing impeller, wherein the central protrusion has at least partly a polygonal circumferential surface.

* * * * *